United States Patent [19]

Bernstein

[11] 4,298,241

[45] Nov. 3, 1981

[54] SPLICER FUSE INTEGRATED IN LINE CORD PLUG

[75] Inventor: Elliot Bernstein, Rockville Centre, N.Y.

[73] Assignee: Bel Fuse, Inc., Jersey City, N.J.

[21] Appl. No.: 115,670

[22] Filed: Jan. 28, 1980

[51] Int. Cl.[3] ..... H01R 13/66

[52] U.S. Cl. ..... 339/147 P

[58] Field of Search ..... 339/147 R, 147 P, 276 T, 339/DIG. 1, 159 C, 223 R; 337/198, 416, 221, 231, 251, 252, 197

[56] References Cited

U.S. PATENT DOCUMENTS 3,291,894 12/1966 Sampson ..... 339/223 R X
3,535,667 10/1970 Harnish et al. ..... 337/197
4,176,902 12/1979 Bernstein ..... 339/147 P

FOREIGN PATENT DOCUMENTS 971167 6/1950 France ..... 337/198

*Primary Examiner*—Eugene F. Desmond
*Attorney, Agent, or Firm*—Ostrolenk, Faber, Gerb & Soffen

[57] ABSTRACT

A fused plug wherein each of the line cord wires is connected within an encapsulating plug to the prongs extending from said plug with a fuse wire extending between each of the line cord wires and the prong. A small sleeve is crimped at one end of each of the fuse wires and, at the opposite end, each such sleeve is connected to the line cord wire. Similar sleeves at the opposite ends of the fuse wire are crimped to the fuse wire and to a wire connected to the prong. A protective tube encases the pair of sleeves which are spaced from each other by the effective length of the fuse wire. Both line cord leads may be similarly through the same type of fuse to the plug prongs. The entire fuse structure as well as the portion of the line cord entering the fuse and the portion of the prongs extending inside the plug are encapsulated by the plug material.

6 Claims, 6 Drawing Figures

FIG. 1.
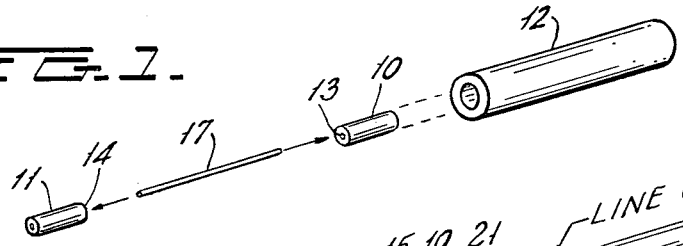
FIG. 2.
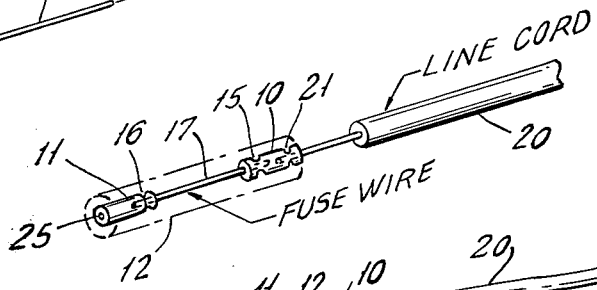
FIG. 3.
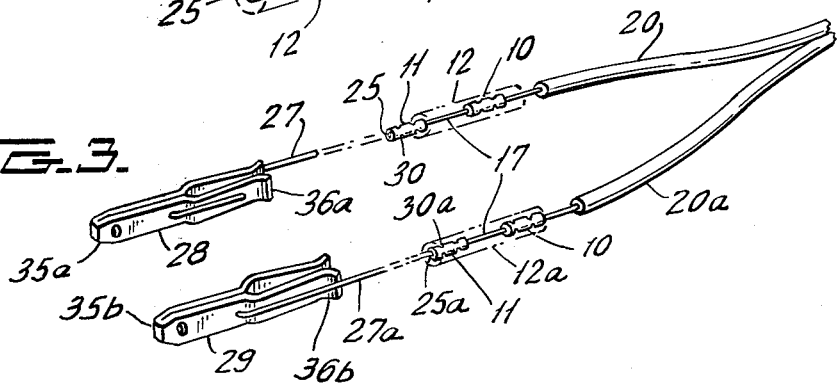
FIG. 5.
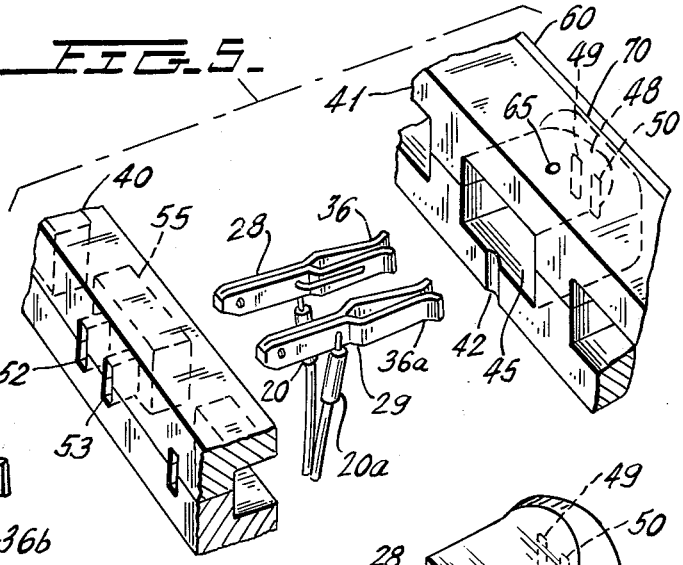
FIG. 4.
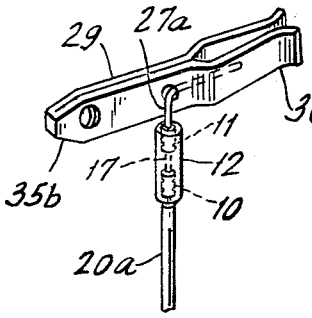
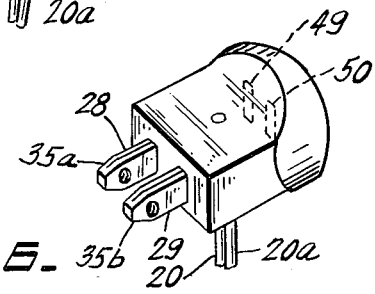
FIG. 6.

SPLICER FUSE INTEGRATED IN LINE CORD PLUG

The present invention relates to fuses and more particularly relates to fuses which are integrated with the plug which itself is substantially integrated with a line cord of the type extending to household appliances including small electrical appliances and Christmas tree cords.

One of the major problems in the construction of such plugs and cords is to follow the necessary requirements to incorporate a fuse which cannot be tampered with preferably within the plug in such manner that the manufacture of the fuse and incorporation thereof will only add a minor factor of increased cost to the manufacture of the entire line cord and plug. Since such line cords and plugs are manufactured competitively at relatively very low prices, the fuse which must be incorporated therewith to meet the requirements particularly of the organizations which set up safety standards must be extremely simple, simple to insert and manufacture and should add the minimum expense consistent with the safety and the meeting of the standards required.

The present invention contemplates the formation of a composite line cord and plug in which the pair of wires are stripped back somewhat and small metallic sleeves are crimped to the ends of the wires. A fuse wire is inserted in each end of the small sleeve at the opposite end from which the line cord wire has been inserted and is also crimped to the wire so that each small sleeve is provided with two such crimps axially spaced from each other. The other end of the fuse wire has a similar small sleeve crimped thereto; the fuse assembly with the two crimped small sleeves at the ends thereof are inserted into a tube which is essentially a protective tube to preserve the integrity of the fuse wire during incorporation in the plug. The male elements of the plug are arranged with wires extending therefrom which are then crimped into the opposite end of the small sleeves at the ends of the fuses opposite the line cord wires.

The entire assembly including the ends of the line cord wires, the fuse and the plugs are then laid in an appropriate mold into which appropriate insulating material is inserted in the proper shape to form the plug, encapsulate the fuse and permit the ends of the male prongs of the plug to extend therefrom.

By this means, therefore, the primary object of this invention is achieved in forming a simplified inexpensive fuse which may readily be manufactured by existing manufacturing operations and incorporated in the fuse plug and encapsulated therewith together with the simultaneous connection of the line cord to the male prongs of the fuse plug.

The foregoing and many other objects of this invention will become apparent in the following description and drawings in which:

FIG. 1 is a schematic view showing the relationship of the two small sleeves of the fuse to the larger fuse covering sleeve. The two small sleeves in use are crimped to the fuse wire as shown in FIG. 2 and inserted within the tube of FIG. 1.

FIG. 2 is a view in perspective showing one of the line cords inserted and crimped to the sleeve at one end of the fuse and in the tube.

FIG. 3 is a schematic view showing the line cords attached to the fuse within the sleeves and the sleeves about to receive a wire secured to and extending from the plug prong.

FIG. 4 is a view of the plug prong showing the line cord attached thereto.

FIG. 5 is a view showing the prongs ready for insertion into the mold to form the plug.

FIG. 6 is a view in perspective of the fused plug.

Referring to the Figures, a pair of sleeves 10, 11 (FIG. 1) are provided which may fit readily into the protective tube 12. A fuse wire is inserted at the end 13 of sleeve 10 and into the end 14 of sleeve 11 and the sleeves are crimped in the areas shown at 15 and 16, respectively, of FIG. 2 in order to secure the sleeves 10 and 11 on the fuse wire 17 indicated in the dotted lines of FIG. 2. The composite fuse wire 17 with the sleeves 10 and 11 are then arranged so that the line cord 20 is inserted into the sleeve 10 which sleeve is crimped at 21 onto the line cord 20. The composite unit is then inserted into the tube 12 with the line cord extending therefrom and the tube 12 is slid back slightly so that the end 25 of sleeve 11 may be slid onto the wire 27 which is soldered to the prong 28 of the fuse plug which is to be formed.

Machines are available which, by vibration or other means, will orient the small tubes 10 and 11 so that they will readily receive the fuse wires and will crimp the tubes 10 and 11 onto the fuse wires and also insert them again by simple mechanical motions, including vibratory activity, into the tube 12. It will be noted, however, that while the tube 12 is a good fit on the sleeve 10 and 11, it should be slightly slidable therewith to permit the crimping operation to occur, especially the connection to the elements 27, **27*a* extending from the prong. The tube 12** then is slidable back to cover both the small sleeves and the fuse wire before the fuse wire and prongs are inserted into the mold for formation of the plug.

The sleeve 11 on each of the line cords 20 and **20*a* is then crimped at 30 and 30*a*, respectively, onto the wires 27 and 27*a*, respectively, of the prong members 28 and 29. The prong members 28 and 29 may more readily be seen individually in FIG. 4 as well as in the composite view of FIG. 5. Each of the prong members 28 and 29 comprises an extending male member 35*a* and 35*b* which is intended to extend outside the plug and a set of contact elements 36*a* and 36*b* which are intended to extend to the opposite end of the plug so that another plug may be inserted through appropriate openings in the plug into the contacts so that the plugs may build upon each other. It will here be seen that the fuse wire 17 is thus virtually an integral extension of the line cord 20 or 20*a* and itself is virtually integrally connected to the wires 27, 27*a* of the plug prongs 28 and 29**.

An alternative method of operation would be to slide the tube 12 back and insert the wires 27, **27*a* into the ends 25, 25*a* of the sleeves 11 and then apply the crimps 30 and 30*a*; thereafter the wires 27, 27*a* may be secured or soldered to the prongs 28, 29**.

The prongs 28, 29 are then laid in the composite mold consisting of the parts 40, 41. In this case the mold 40–41 is a two part mold with recesses at 42, 43 for the line cord elements 20 and **20*a* at each mold section and a hollow section 45 into which the contact ends 36 and 36*a* of the prongs 28 and 29 may be laid. The composite fuse element indicated now by the tube 12 attached, in FIG. 5 between the line cord elements 20 and 20*a* and the prongs 28 and 29, may fit into the recesses 42, 43 while the contact members 36, 36*a* extend to the back wall 48 of the recess 45 to line up with openings 49 and 50 through which, in the completed plug, another set of prongs may be inserted to engage the contacts 36, 36***a*.

The mold sections 40, 41 are then brought together with the prong sections 28*a* and 29*a* extending through the openings 52 and 53 of the recess 55 which matches the recess 45 and a holding plate 60 is placed against the opposite back wall of the mold section 41 to cover the openings 50. The mold is then charged through any appropriate opening such as the opening 65 with the insulating material which may be thermoplastic or thermosetting. The material, which thus encapsulates the inserted portion of the prongs and the fuse and the portion of the line cord extending thereinto, is formed; and the plug (FIG. 6) is removed. When the mold is filled the material filling the mold may fill up the entrance hole 65; or the entrance hole 65 for the encapsulating plug forming material may be otherwise plugged. Also it may be desirable, instead of using the holding plate 60 to insert some neutral member such as a thin plastic or wood slat into the contacts 36, 36*a* to stick out through the openings 49 and 50 in the back of the mold to prevent the inner surface of the contacts from being contaminated by the plug forming material and to maintain the integrity of the openings 49 and 50; such slat may then readily be removed.

In this way, a simplified plug is formed with an inexpensive encapsulated fuse integral therewith and so integrated therewith that the fuse cannot be tampered with without destroying the plug, thereby providing the tamperproof element of safety which is required by standards frequently applied to line cords for small appliances or Christmas tree cords or strings as well as protecting the fuse from either mechanical or even thermal ambient situations not caused by the current passing through the line cord itself.

In the foregoing the present invention has been described in connection with illustrative embodiments thereof. Since many variations and modifications of the present invention will now be obvious to those skilled in the art it is preferred that the scope of this disclosure be determined not by the particular embodiments herein contained but only by the appended claims.

What is claimed is:

1. A fused plug having a main body; a pair of prongs extending from said main body and a line cord having a pair of wires extending into said main body;

a fused connection between at least one of said wires and one of said prongs; said fused connection comprising a fuse wire, a sleeve secured at one end of the sleeve to one end of said fuse wire, the other end of said sleeve being secured to said line cord wire, the opposite end of said fuse wire being connected electrically to one of said prongs; said sleeve being crimped to the first end of the fuse wire at one end of said sleeve, the opposite end of said sleeve being crimped to said line cord wire; and an additional wire connected to said prong and a second sleeve secured to said opposite end of the fuse wire remote from the line cord wire; the end of the second sleeve opposite the end which is connected to the fuse wire being connected to said additional wire; said two sleeves being spaced from each other with the fuse wire extending between.

2. The fused plug of claim 1, in which said sleeves and fuse wire extend linearly, an additional protective tube being mounted over said sleeves and fuse wire; said sleeves being substantially close fit within said additional protective tube.

3. The fused plug of claim 2, wherein two of said sleeves for each line cord wire are respectively crimped at one end of each sleeve to a fuse wire and at the opposite end of each respectively to a line cord wire and the wire connected to the prong.

4. The fused plug of claim 3, wherein both of said pair of line cord wires and both of said prongs have the fuse wires, sleeves and protective tube secured therebetween.

5. The fused plug of claim 4, wherein the material forming the body of said plug is a solid material encapsulating said fuses and the portion of the line cord entering the plug as well as a portion of the prong extending within said plug.

6. The fused plug of claim 5, wherein each of the prongs is provided with contacts at the end opposite the portion of the prong which extends from the plug; and a pair of openings in the wall of the plug opposite from which the prongs extend; said openings coinciding with the contacts of said prongs.

* * * * *